US009641948B2

(12) United States Patent
Hansson et al.

(10) Patent No.: US 9,641,948 B2
(45) Date of Patent: May 2, 2017

(54) METHOD AND SYSTEM FOR AUDIO CALIBRATION OF AN AUDIO DEVICE

(71) Applicant: Axis AB, Lund (SE)

(72) Inventors: Anders Hansson, Klagerup (SE); Niklas Hansson, Horby (SE); Magnus Rolf, Malmo (SE); Johan Adolfsson, Sodra Sandby (SE)

(73) Assignee: Axis AB, Lund (SE)

( * ) Notice: Subject to any disclaimer, the term of this patent is extended or adjusted under 35 U.S.C. 154(b) by 0 days.

(21) Appl. No.: 14/931,428

(22) Filed: Nov. 3, 2015

(65) Prior Publication Data

US 2016/0134983 A1 May 12, 2016

(30) Foreign Application Priority Data

Nov. 6, 2014 (EP) ..... 14192094

(51) Int. Cl.
*H04R 29/00* (2006.01)
*H04S 7/00* (2006.01)
*H04R 1/22* (2006.01)

(52) U.S. Cl.
CPC ..... *H04R 29/001* (2013.01); *H04R 1/22* (2013.01); *H04R 29/008* (2013.01); *H04S 7/301* (2013.01)

(58) Field of Classification Search
CPC ..... H04R 29/001; H04R 29/008; H04R 1/22; H04S 7/301
USPC ..... 381/59, 303
See application file for complete search history.

(56) References Cited

U.S. PATENT DOCUMENTS

| | | | | |
|---|---|---|---|---|
| 8,704,866 | B2 * | 4/2014 | Igoe | H04L 12/2809 348/14.04 |
| 2010/0142735 | A1 * | 6/2010 | Yoon | H04S 3/002 381/303 |
| 2012/0113224 | A1 | 5/2012 | Nguyen et al. | |
| 2012/0140957 | A1 | 6/2012 | Poulsen et al. | |
| 2015/0138370 | A1 * | 5/2015 | Vilermo | H04S 7/302 348/180 |

FOREIGN PATENT DOCUMENTS

| | | |
|---|---|---|
| EP | 2 608 511 A1 | 6/2013 |
| JP | 2006174216 | 6/2006 |
| KR | 10 1229333 B1 | 2/2013 |
| WO | 2014032709 A1 | 3/2014 |

OTHER PUBLICATIONS

EP 14 19 2094.2 European Search Report (Apr. 29, 2015).
THX tune-up™ App for Android THX (Jul. 2, 2014).
VSX-1022K Receiver Pioneer Electronics US (Jul. 2, 2014).

* cited by examiner

*Primary Examiner* — Van D Huynh
(74) *Attorney, Agent, or Firm* — Volpe and Koenig, P.C.

(57) ABSTRACT

A method for audio calibration of an audio device is provided. The method comprises: registering, by a microphone, a representation of an audio signal; processing, by a data processing unit, the registered representation of the audio signal into feedback image data; displaying on a display, the feedback image data; capturing, by a camera, the feedback image data displayed on the display; altering a setting affecting audio of the audio device based on the feedback image data captured by the camera. A system for audio calibration of an audio device is further provided.

15 Claims, 4 Drawing Sheets

METHOD AND SYSTEM FOR AUDIO CALIBRATION OF AN AUDIO DEVICE

FIELD OF INVENTION

The invention relates to a method and a system for audio calibration of an audio device.

BACKGROUND

The auditory experience of an audio device may be changed by altering settings affecting audio of the audio device. In other words, settings such as the volume, balance, treble and/or the position of the audio device or a part thereof may be altered such that a desired auditory experience may be obtained. It is, however, complicated for an installer and/or a user of the audio device to access and set the settings affecting audio based on the auditory experience. The situation is further complicated by the auditory experience being influenced by the environment of the audio device. The environment may for example comprise ambient sounds as well as sound obstructing objects such that the auditory experience is affected. The audio device or parts thereof may furthermore be visually obstructed for and/or be placed at a distance from the installer and/or user which may hinder an efficient altering of settings affecting audio of the audio device to change the auditory experience.

SUMMARY

It is an object of the present invention to provide a more efficient method for performing an audio calibration of an audio device.

According to a first aspect of the invention this and other objects are achieved by providing a method for audio calibration of an audio device. The method comprises registering, by a microphone, a representation of an audio signal; processing, by a data processing unit, the registered representation of the audio signal into feedback image data; displaying, on a display, the feedback image data; capturing, by a camera, the feedback image data displayed on the display; altering a setting affecting audio of the audio device based on the feedback image data captured by the camera.

The term audio signal should be understood as any auditory signal. In an embodiment, the audio signal comprises frequencies in the audio frequency range of about 20 to 20 000 Hz. In other words, the audio signal comprises at least one tone that is audible for a human. The audio signal may comprise a plurality of tones which are simultaneous or sequential in time. The audio signal may comprise frequencies which are outside the audio frequency range, i.e. outside the limits of human hearing, but which may be registered by an audio microphone. The audio signal may originate from ambient sound. The audio signal may be emitted from a loudspeaker.

The term feedback image data should further be understood as data being fed back as a response to the sender of the audio signal. The feedback image data may be represented, i.e. visualized by for example pixels, as an image on a display. In other words the feedback image data may comprise an optical machine-readable representation of data.

An advantage of the method is that an information channel is established between the camera and the display, through which the feedback image data resulting from the registered representation of the audio signal may be transferred, and based on which a setting affecting audio of the audio device may be altered. In other words, feedback on the perceived audio signal as registered by the microphone is via the display provided to facilitate calibration of the audio device.

By opening a new information channel constraints in bandwidth of a common channel, such as a network channel, between the camera and the display are mitigated. A simple and effective audio calibration of the audio device is obtained. The method simplifies for the installer and/or a user of the audio device to obtain a desired auditory experience The registering of the audio signal may be performed by a microphone of a peripheral device. An installer and/or a user of the audio device may thereby use the peripheral device for registering the audio signal. Efficient and reproducible registering of the representation of the audio signal is thereby provided independent of, for instance, the audio registering capability of a specific installer and/or user. The peripheral device further allows for efficient positioning of the microphone relative to the audio device. By being able to position the peripheral device at different positions which may have varying distances relative to the audio device an improved calibration of the audio device may be obtained. In other words, by using a plurality of calibration points, i.e. positions of the peripheral device relative to the position of the audio device, an improved audio calibration of the audio device may be obtained.

The processing of the registered representation of the audio signal into feedback image data may be performed on a data processing unit of a peripheral device. An advantage is that the feedback image data may be provided by the peripheral device without any need of additional processing means. Communication between the peripheral device and other data processing units outside the peripheral device is not needed for providing the feedback image data. A simple and cost effective method for calibrating an audio device is thereby provided.

The displaying of the feedback image data may be performed on a display of a peripheral device. The presentation of the feedback image data may thereby be presented in a simple and direct manner to a camera such that the camera may capture the feedback image data. The feedback image data may additionally be displayed to, for example, an installer and/or a user of the audio device. A simple and cost effective method for calibrating an audio device is provided as additional means for displaying the feedback image data are not needed. An installer and/or a user of the audio device who has access to the peripheral device may moreover in an effective manner access the feedback image data.

Capturing of the feedback image data may be performed by a camera of the audio device. The audio device may thereby directly access the displayed feedback image data. An efficient transmission of the feedback image data from the display to the audio device is thereby provided.

The method may further comprise emitting the audio signal by a loudspeaker. An improved control of the physical characteristics, such as the tone spectrum and volume, of the audio signal may thereby be obtained. A desired spectral and amplitude distribution of the audio signal may thereby be provided. A desired temporal distribution of the emitting of the audio signal may further be achieved.

By selecting an appropriate loudspeaker and/or controlling its position the directionality of the emitting of the audio signal may be controlled such that the microphone may efficiently register a representation of the audio signal.

The emitting of the audio signal may be performed by a loudspeaker of the audio device. An improved audio calibration of the audio device may be obtained as the loudspeaker used during operation of the audio device may also be used for emitting the audio signal. A simple and efficient method for providing audio calibration of the audio device may thereby be provided.

The feedback image data may comprise a still image or a video sequence. A still image or a video sequence may efficiently provide feedback image data based on which a setting affecting audio of the audio device may be altered.

The feedback image data may comprise at least one of a QR code, a bar code, a text, and a diagram. Distinct and comprehensible feedback image data may thereby be provided. A clear and simple presentation of the registered representation of the audio signal is provided.

The term diagram should here also be interpreted broadly to include two-dimensional and three-dimensional visualizations of data as black and white and/or colored graphs, histograms or charts.

The processing, by the data processing unit, may further comprise processing the registered representation of the audio signal such that the feedback image data comprises a representation of how to alter the setting affecting audio of the audio device. An efficient channel for providing an indication of how to alter a setting affecting audio of the audio device based on the feedback image data captured by the camera may thereby be provided. By providing a representation of how to alter the setting affecting audio an efficient audio calibration is achieved such that a desired audio experience may be achieved. A simple and effective audio calibration of the audio device is further provided.

The method may further comprise processing, by a data processing unit of the audio device, the feedback image data to decide how to alter the audio setting of the audio device. A setting affecting audio of the audio device based on the feedback image data may thereby efficiently be altered by the audio device such that an audio calibration of the audio device is performed.

The peripheral device may be a cell phone, a personal digital assistant, a computer, a tablet computer, or an audio calibration device, the peripheral device comprising a microphone and a display. A versatile method for audio calibration of an audio device is thereby provided.

The audio device may be an intercommunication station.

The term intercommunication station should be understood as a station which allows for a one- or two-way audible communication, also referred to as simplex or duplex communication respectively, between two separated locations. The duplex communication may be full-duplex or half-duplex. The intercommunication station thereby allows for point-to-point communication. The intercommunication station may for example allow a person speaking into the intercommunication station to be heard at a location being remote from the intercommunication station. A person being near the intercommunication station may further be communicated with via the intercommunication station.

According to a second aspect of the invention a system for audio calibration of an audio device is provided. The system comprises an audio setting unit, a camera, a microphone, a data processing unit, and a display, wherein the microphone is arranged to register a representation of an audio signal, wherein the data processing unit is arranged to process the registered representation of the audio signal into feedback image data, and wherein the display is arranged to display the feedback image data; wherein the camera is arranged to capture the feedback image data displayed on the display, and wherein the audio setting unit is arranged to alter a setting affecting audio of the audio device based on the feedback image data captured by the camera.

The system may further comprise a loudspeaker, the loudspeaker being arranged to emit an audio signal.

The function and benefits of the system for audio calibration of an audio device are described above in relation to the method. The above mentioned features, when applicable, apply to this second aspect as well.

It is noted that the invention relates to all possible combinations of features recited in the claims.

BRIEF DESCRIPTION OF THE DRAWINGS

These and other aspects of the present invention will now be described in more detail, with reference to the appended drawings showing embodiments of the invention. As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION OF THE PREFERRED EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and to fully convey the scope of the invention to the skilled person.

In the following a method and a system for audio calibration of an audio device will be described with reference to the FIGS. 1-5.

Figure 1:
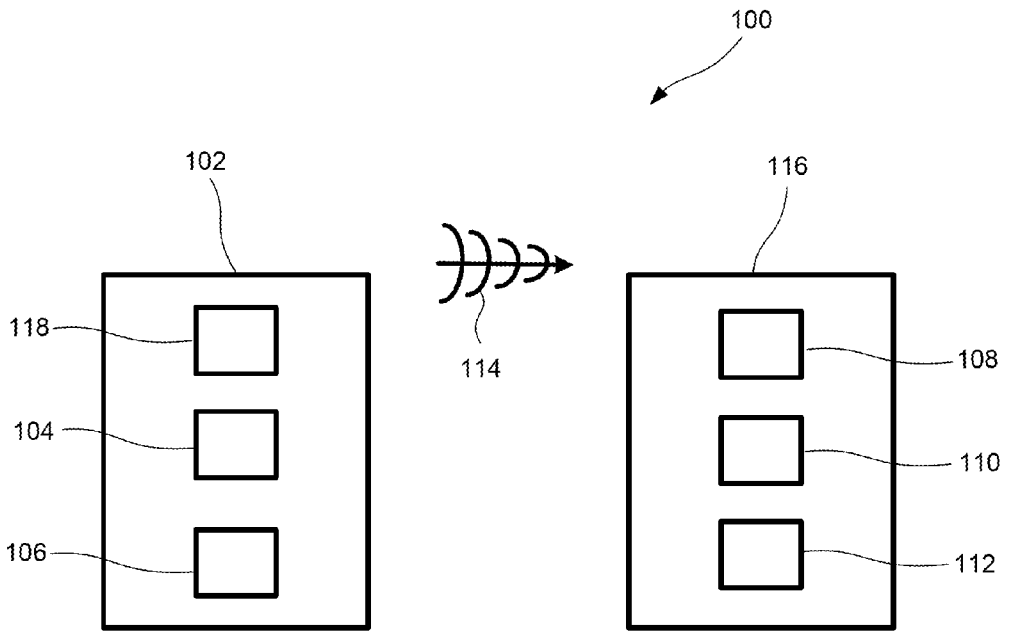
FIG. 1 illustrates a system for audio calibration of an audio device according to one embodiment of the present invention.

FIG. 1 illustrates the system 100 for audio calibration of an audio device 102 according to one embodiment of the present invention. The system 100 comprises an audio setting unit 104, a camera 106, a microphone 108, a data processing unit 110, and a display 112.

The microphone 108 is arranged to register a representation of an audio signal 114. The microphone 108 is an audio microphone.

The data processing unit 110 is arranged to process the registered representation of the audio signal 114 into feedback image data. The image feedback data is further displayed on the display 112 such that the displayed feedback image data may be captured by the camera 106. The audio setting unit 104 is arranged to alter a setting affecting audio of the audio device 102, based on the feedback image data captured by the camera 106 as will be further discussed below.

According to this embodiment the camera 106 and the audio setting device 104 are incorporated with the audio device 102. This is advantageous as a stand-alone audio device 102 may be provided. The audio device 102 is in this embodiment an intercommunication station such as a door station.

The microphone 108, the data processing unit 110 and the display 108 are according to this embodiment integrated into a peripheral device 116. The peripheral device 116 may be a hand held device. The peripheral device 116 may for example be a cell phone, a personal digital assistant, a computer, a tablet computer, or an audio calibration device comprising the microphone and the display.

An information channel is established between the camera 106 and the display 112. As a result constraints in the bandwidth of a common channel, such as a network channel between the audio device 102 and the peripheral device 116 may, for example, be reduced. In other words, the information channel provided by the camera 106 and the display 112 results in that the peripheral device 116 does not need to communicate via communication networks such as a telecommunication network. The communication network may alternatively be provided by an internet, the Internet, or an Ethernet such as a local area network, LAN. A simple and cost effective exchange of information between the audio device 102 and the peripheral device 116 is thereby obtained.

According to this embodiment the system 100 further comprises a loudspeaker 118 arranged to emit the audio signal 114. It is advantageous that the audio device 102 comprises the loudspeaker 118 for emitting an audio signal 114 as the same loudspeaker 118 may then be used for audio calibration of the audio device 102 and for providing audio signals to an installer and/or user of the audio device 102. A more efficient audio calibration of the audio device 102 may thereby be provided. By the audio device 102 providing the emitting of the audio signal 114 using the loudspeaker 118*a*, for the situation, preferred and optimized audio signal 114 may be used. In other words, an improved control of the physical characteristics, such as the tone spectrum and volume, of the audio signal may thereby be obtained.

The audio signal 114 may for example comprise frequencies in the audio frequency range of about 20 to 20 000 Hz. The audio signal 114 thereby comprises at least one tone that is audible for a human. An audio calibration of the audio device 102 may thereby be provided within a frequency span which is hearable and thereby relevant for a user of the audio device 102.

The audio signal 114 may further comprise a plurality of tones which are simultaneous or sequential in time which may improve the quality of the audio calibration. The audio signal 114 may be a calibration tone.

The audio signal 114 may further comprise frequencies which are outside the audio frequency range, i.e. outside the limits of human hearing, but which may be registered by an audio microphone 108. This may be advantageous to provide an improved auditory experience for the user of the audio device 102.

The audio signal 114 may further comprise ambient sound, i.e. sound from a sound source not being the loudspeaker 118, to which the microphone 108 is exposed. This is advantageous as, for example, the background sound of the audio device 102 and/or the peripheral device 116 may be taken into account when performing the audio calibration of the audio device 102. The sound landscape at a busy street may for example be taken into account when calibrating the audio device 102 such that a user of the audio device 102 may, after the audio calibration better distinguish sound emitted by the loudspeaker 118 of the audio device 102 from the ambient sound. An improved auditory experience is thereby provided by the system 100.

According to other embodiments the audio signal may comprise only ambient sound. The ambient sound is used for calibration of the audio device. Hence, there is according to such an embodiment no need of a loudspeaker emitting an audio signal for audio calibration. A system for audio calibration of an audio device comprising fewer parts is thereby provided.

It should be noted that the audio device 102 may further comprise a microphone (not shown). An audio device 102 which is full duplex may thereby be provided. An installer and/or user of the audio device 102 may via the audio device 102, i.e. by means of its camera 106, loudspeaker 118 and microphone, communicate with the audio device 102 and an operator of the audio device 102. In other words, the audio device 102 allows for point-to-point communication such that the installer and/or user of the audio device 102 speaking into the audio device 102 may be heard at a location being remote from the audio device 102.

Still referring to FIG. 1, the data processing unit 110 is shown to be part of the peripheral device 116. The data processing unit 110 is arranged to process the representation of the audio signal 114 registered by the microphone 108. The registered representation of the audio signal 114 is further processed into feedback image data. The feedback image data is displayed on the display 112 of the peripheral device 116 such that it may be captured by the camera 106 of the audio device 102. An advantage is that the feedback image data may be provided by the peripheral device 116 without any need of additional processing means. Communication between the peripheral device 116 and other data processing units outside the peripheral device 116 is therefore not needed for providing the feedback image data. A simple and cost effective calibration of the audio device is provided.

It should, however, be noted as will be discussed below that the data processing unit may be arranged outside the peripheral device 116.

Figure 2:
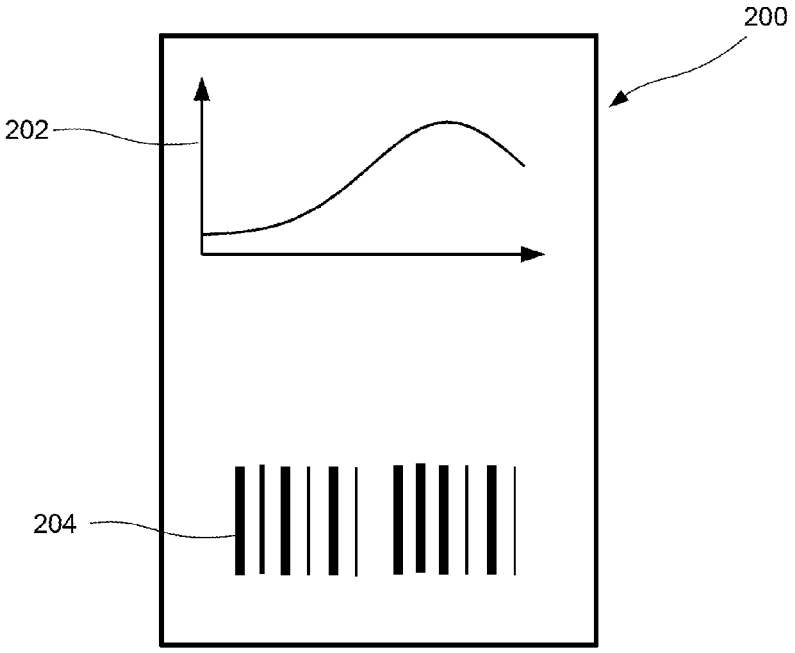
FIG. 2 illustrates the displaying of feedback image data according to one embodiment of the present invention.

FIG. 2 illustrates the displaying of the feedback image data performed on a display 112 of a peripheral device 116. According to this embodiment the feedback image data comprises a still image 200 displaying a diagram 202 and a machine-readable bar code 204. The diagram 202 and the bar code 204 provide information regarding the, by the microphone 108, registered representation of the audio signal 114 emitted from the loudspeaker 118. The feedback image data may thereby be presented in a simple and direct manner to for example an installer and/or a user of the audio device.

It should be noted that the feedback image data may in different embodiments comprise simple information such as "this is the registered audio signal" or alternatively more complex information, i.e. comprising information related to the registered audio signal processed by a data processing unit. The complex information may for example comprise information on how to alter settings effecting audio of the audio device 102.

The feedback image data may comprise information regarding a difference between a predetermined emitted audio signal, emitted by the loudspeaker 118 and a registered representation of the predetermined audio signal as registered by the microphone 108. The difference may for example be obtained if the spectral characteristics of the predetermined audio signal are known to the peripheral device. The predetermined audio signal may be standardized.

According to other embodiments the peripheral device may provide information to the audio device relating to the spectral characteristics of the audio signal that should be emitted from the audio device.

An installer and/or a user of the audio device who has access to the peripheral device may moreover in an effective manner access the feedback image data. The installer of the audio device 102 may, based on the displayed still image 200, gain knowledge about the calibration status of the audio device 102. The diagram 202 of the displayed still image 200 may for example indicate that the calibration of the audio device 102 is such that the spectral characteristics of the emitted audio signal 114 and the registered representation of the audio signal 114 agree within a predetermined tolerance range. In such a case no further calibration of the audio device 102 may be needed.

In another situation, however, the installer of the audio device 102 may be made aware by the displayed still image 200 that further calibration of the audio device 102 is needed. Alternatively, the audio setting unit 104 may, based on the captured displayed still image 200, determine if further calibration of the audio device 102 is needed.

The feedback image data displayed may provide information to an installer and/or user of the audio device 102 on where to position the peripheral device 116, i.e. the microphone 108 and/or display 112 of the peripheral device 116, in relation to the audio device 102. Calibration of the audio device 102 may thereby be performed at specific positions in the surrounding of the audio device 102 which may be relevant for the operation of the audio device 102. The peripheral device 116 may for example be placed at a position where an installer and/or user of the audio device 102 is likely to be placed in relation to the audio device 102. The peripheral device 116 may further be placed at different positions such that an improved calibration of the audio device 102 is obtained. This is advantageous as an installer and/or user of the audio device may be positioned at different positions relative to the audio device 102 depending on if the audio device 102 or parts thereof are obstructed. Problems associated with the audio device 102 or parts thereof being placed at a distance from the installer and/or user of the audio device 102 which may hinder direct altering of settings affecting audio are further mitigated such that efficient altering of a setting affecting audio of the audio device is provided.

The still image 200 is arranged to efficiently provide feedback image data to be captured by the camera 106. The audio setting unit 104 may, based on the feedback image data captured by the camera 106, alter a setting affecting audio of the audio device 102. The machine-readable bar code 204 of the still image 200 provides a simple and direct image which may efficiently be captured by the camera 106 of the audio device 102. A simple and cost effective method for calibrating an audio device 102 is provided as additional means for displaying the feedback image data are not needed.

According to other embodiments the feedback image data may comprise at least one of a QR code, a bar code, a text, and a diagram. Distinct and comprehensible feedback image data may thereby be provided. A clear and simple presentation of the registered representation of the audio signal is provided.

According to other embodiments the feedback image data may comprise a video sequence.

Figure 3:
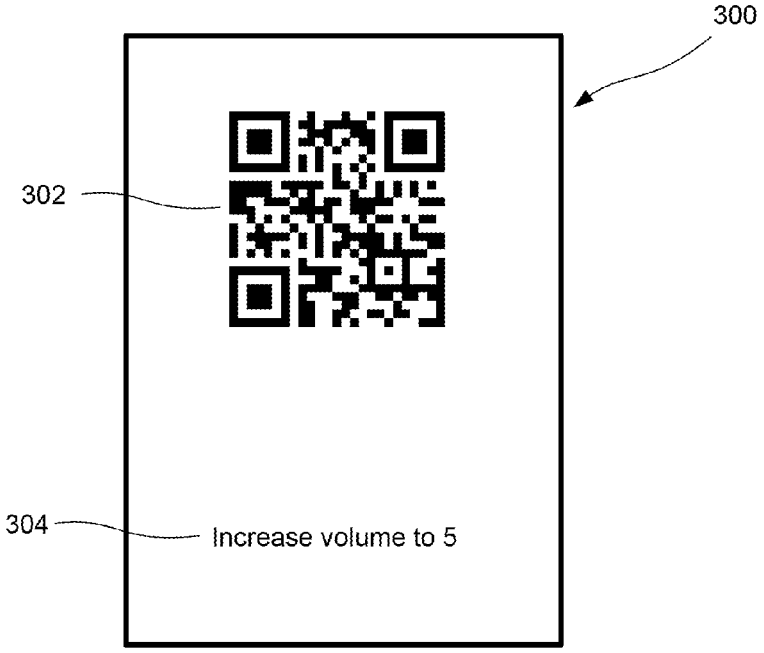
FIG. 3 illustrates the displaying of feedback image data according to another embodiment of the present invention.

FIG. 3 illustrates feedback image data being displayed on a display 112 according to another embodiment of the invention. The feedback image data is presented as a still image 300 and comprises a representation of how to alter the setting affecting audio of the audio device. The still image 300 comprises feedback image data displayed as a Quick Response Code, QR code, 302. As an example, the QR code 302 displays the instruction "Increase volume to 5", as further displayed as a text 304 on the display 112. The instruction results from the processing of the registered representation of the audio signal 114 such that the feedback image data comprises a representation of how to alter the setting affecting audio of the audio device which may be captured by the camera 106.

After capture of the feedback image data the audio setting unit 104 of the audio device 102 may alter the setting affecting audio of the audio device 102, based on the instruction. An efficient channel for providing an indication of how to alter a setting affecting audio of the audio device 102 based on the feedback image data may thereby be provided. By providing an instruction of how to alter the setting affecting audio an efficient audio calibration of the audio device 102 is achieved such that a desired audio experience may be provided by the audio device 102.

Figure 4:
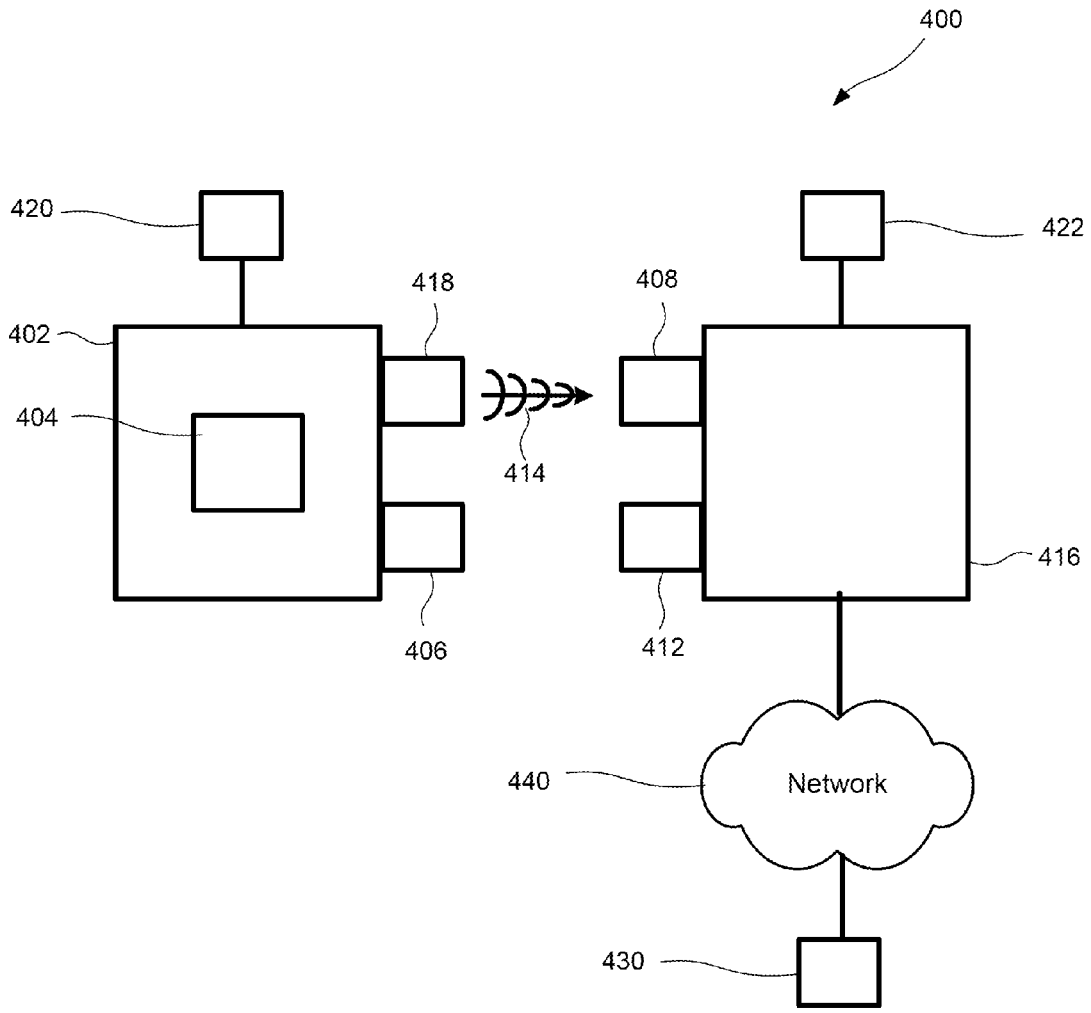
FIG. 4 illustrates a system for audio calibration of an audio device according to another embodiment of the present invention.

FIG. 4 illustrates a system 400 for audio calibration of an audio device 402 according to another embodiment of the present invention. The system 400 comprises an audio setting unit 404, a camera 406, a microphone 408, and a plurality of data processing units 420, 422, 430, and a display 412. The camera 406 and the audio setting device 404 are comprised in the audio device 402. The system 400 further comprises a loudspeaker 418 arranged to emit an audio signal 414.

The microphone 408 and the display 408 are comprised in a peripheral device 416.

The data processing unit 430 is arranged outside the peripheral device 416. The data processing unit 430 may be located within a communications network 440 such as a local area network, a LAN, an internet or a telecommunication network. The requirements of the peripheral device 416 to process data such as data pertaining to a registered representation of an audio signal 414 are thereby reduced.

The audio device 402 and/or the peripheral device 416 also comprise data processing units as illustrated by data processing units 420 and 422. The data processing unit 420 of the audio device 402 may for example be arranged to process the feedback image data displayed on the display 412 which is captured by the camera 406 such that the audio setting unit 404 receives input data of how to alter a setting affecting audio of the audio device 402. The data processing unit 420 of the audio device 402 may further be arranged to process the feedback image data to decide how to alter the audio setting of the audio device 402. This allows for efficient audio calibration also if the processing unit 430 is for example temporarily without connection to the peripheral device 416.

The data processing unit 422 of the peripheral device 416 and the data processing unit 430 may jointly or individually process the registered representation of the audio signal into feedback image data and/or to display, on the display 412, the feedback image data.

According to other embodiments the data processing unit 420 of the audio device 402 and an additional data processing unit (not shown), the additional data processing unit being comprised within a communicating network, may jointly or individually provide data input for altering setting affecting audio of the audio device 402 based on the feedback image data captured by the camera 406 and/or to processing the captured feedback image data to decide how to alter the audio setting of the audio device 402.

Figure 5:
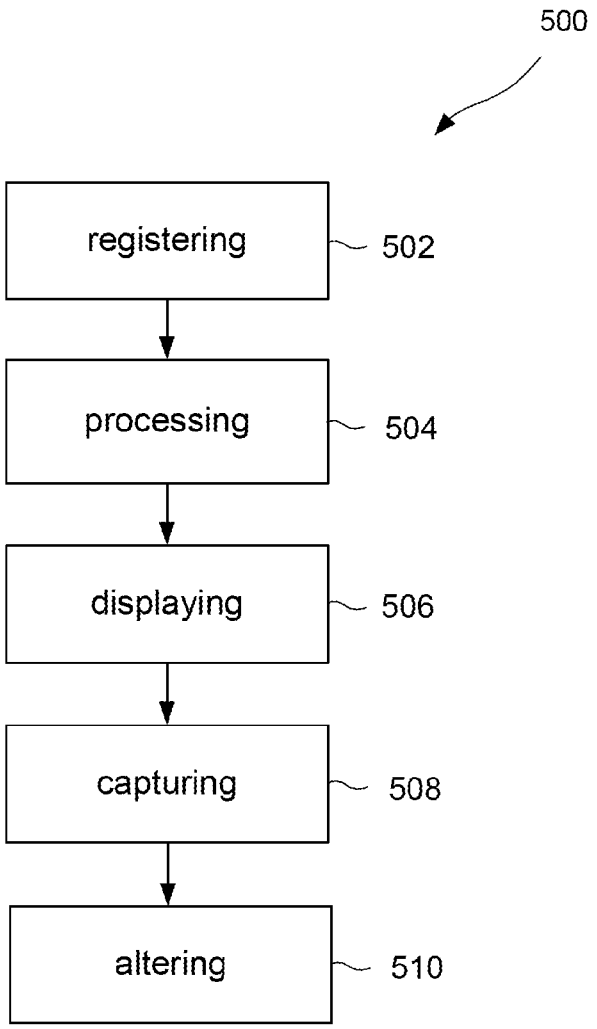
FIG. 5 illustrates a method for audio calibration of an audio device according to one embodiment of the present invention

Referring to FIG. 5, a method 500 for audio calibration of an audio device is illustrated. The method 500 comprises the steps of registering 502, by a microphone, a representation of an audio signal; processing 504, by a data processing unit, the registered representation of the audio signal into feedback image data; displaying 506, on a display, the feedback image data; capturing 508, by a camera, the feedback image data displayed on the display; altering 510 a setting affecting audio of the audio device based on the feedback image data captured by the camera.

The function and benefits of using the method 500 are described above in relation to the system for calibration of an audio device. In order to avoid undue repetition, reference is made to the above.

The person skilled in the art realizes that the present invention by no means is limited to the preferred embodiments described above. On the contrary, many modifications and variations are possible within the scope of the appended claims.

The audio system may comprise a loudspeaker (not shown) which is connected via a network to the audio device. The loudspeaker may thereby be remotely connected to the audio device. A modular audio device may thereby be provided which may be configured for different situations. The loudspeaker may for example easily be exchanged depending on the auditory experience that is desired. The audio system may further comprise several loudspeakers.

The camera and the display may moreover belong to different network channels or networks which simplifies and increases the versatility of the method for audio calibration of the audio device.

The audio device may be a door station.

Additionally, variations to the disclosed embodiments can be understood and effected by the skilled person in practicing the claimed invention, from a study of the drawings, the disclosure, and the appended claims. The word "comprising" does not exclude other elements or steps, and the indefinite article "a" or "an" does not exclude a plurality. The mere fact that certain measures are recited in mutually different dependent claims does not indicate that a combination of these measures cannot be used to advantage.

What is claimed is:

1. A method for audio calibration of an audio device, the method comprising:

registering, by a microphone of a peripheral device, a representation of an audio signal;

processing, by a data processing unit, the registered representation of the audio signal into feedback image data;

displaying, on a display of the peripheral device, the feedback image data;

capturing, by a camera of the audio device, the feedback image data displayed on the display;

altering a setting affecting audio of the audio device based on the feedback image data captured by the camera.

2. The method according to claim 1, wherein the processing of the registered representation of the audio signal into feedback image data is performed on a data processing unit of the peripheral device.

3. The method according to claim 1, further comprising emitting the audio signal by a loudspeaker.

4. The method according to claim 3, wherein the emitting of the audio signal is performed by a loudspeaker of the audio device.

5. The method according to claim 1, wherein the feedback image data comprises a still image or a video sequence.

6. The method according to claim 1, wherein the feedback image data comprises at least one of a Quick Response (QR) code, a bar code, a text, and a diagram.

7. The method according to claim 1, wherein the processing, by the data processing unit, further comprises processing the registered representation of the audio signal such that the feedback image data comprises a representation of how to alter the setting affecting audio of the audio device.

8. The method according to claim 1, further comprising processing, by a data processing unit of the audio device, the feedback image data to decide how to alter the audio setting of the audio device.

9. The method according to claim 2, wherein the peripheral device is a cell phone, a personal digital assistant, a computer, a tablet computer, or an audio calibration device, the peripheral device comprising a microphone and a display.

10. The method according to claim 1, wherein the audio device is an intercommunication station.

11. A system for audio calibration of an audio device, the system comprising:

the audio device comprising a camera and an audio setting unit, a peripheral device comprising a microphone and a display, and a data processing unit, wherein the microphone is arranged to register a representation of an audio signal, wherein the data processing unit is arranged to process the registered representation of the audio signal into feedback image data, wherein the display is arranged to display the feedback image data, wherein the camera is arranged to capture the feedback image data displayed on the display, and wherein the audio setting unit is arranged to alter a setting affecting audio of the audio device based on the feedback image data captured by the camera.

12. The system according to claim 11, further comprising a loudspeaker, the loudspeaker being arranged to emit an audio signal.

13. The system according to claim 12, wherein the audio device comprises the loudspeaker.

14. The system according to claim 11, wherein the feedback image data comprises at least one of a Quick Response (QR) code, a bar code, a text, and a diagram.

15. The system according to claim 11, wherein the data processing unit is arranged to process the registered representation of the audio signal such that the feedback image data comprises a representation of how to alter the setting affecting audio of the audio device.

* * * * *